US008069048B2

(12) United States Patent
Kim et al.

(10) Patent No.: US 8,069,048 B2
(45) Date of Patent: Nov. 29, 2011

(54) SCALABLE AUDIO ENCODING AND DECODING APPARATUS, METHOD, AND MEDIUM

(75) Inventors: Dohyung Kim, Hwaseong-si (KR); Miyoung Kim, Suwon-si (KR); Shihwa Lee, Seoul (KR); Sangwook Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 414 days.

(21) Appl. No.: 11/528,314

(22) Filed: Sep. 28, 2006

(65) Prior Publication Data

US 2007/0071089 A1 Mar. 29, 2007

(30) Foreign Application Priority Data

Sep. 28, 2005 (KR) ..... 10-2005-0090747

(51) Int. Cl.
*G10L 19/00* (2006.01)

(52) U.S. Cl. ..... 704/500; 704/503; 704/229

(58) Field of Classification Search ..... 704/500, 704/501, 222, 229, 230
See application file for complete search history.

(56) References Cited

U.S. PATENT DOCUMENTS

| | | | | |
|---|---|---|---|---|
| 6,094,636 | A * | 7/2000 | Kim | 704/500 |
| 6,115,688 | A * | 9/2000 | Brandenburg et al. | 704/503 |
| 6,115,689 | A * | 9/2000 | Malvar | 704/503 |
| 6,182,031 | B1 * | 1/2001 | Kidder et al. | 704/205 |
| 6,349,284 | B1 * | 2/2002 | Park et al. | 704/500 |
| 6,438,525 | B1 * | 8/2002 | Park | 704/500 |
| 6,446,037 | B1 * | 9/2002 | Fielder et al. | 704/229 |
| 6,502,069 | B1 * | 12/2002 | Grill et al. | 704/219 |
| 7,277,849 | B2 * | 10/2007 | Streich et al. | 704/229 |
| 7,343,287 | B2 * | 3/2008 | Geiger et al. | 704/230 |
| 2006/0023748 | A1 * | 2/2006 | Chandhok et al. | 370/469 |
| 2006/0116871 | A1 | 6/2006 | Kim et al. | |

FOREIGN PATENT DOCUMENTS

KR 10-2006-0060928 6/2006

OTHER PUBLICATIONS

Chen, T. "Multimedia Systems, Standards, and Networks." Marcel Dekker, New York 2000, pp. 143-146.*

U.S. Patent Application Publication No. 2006-0116871 (published Jun. 1, 2006), Abstract, Drawing and Claim (3pp only).

* cited by examiner

*Primary Examiner* — Talivaldis Ivars Smits
*Assistant Examiner* — Shaun Roberts
(74) *Attorney, Agent, or Firm* — Staas & Halsey LLP

(57) ABSTRACT

Provided is a scalable encoding method, apparatus, and medium. The method includes: encoding a base layer and encoding a first enhancement layer and a second enhancement layer in a frame having the base layer; and generating an encoded frame by synthesizing the encoded results. Accordingly, only if the loss of the encoding frame is not as great as the encoded first enhancement layer is damaged, a case where speech restoration with respect to partial frequency bands must be given up does not occur. Furthermore, since an encoder divides the second enhancement layer into a plurality of layers in a horizontal or vertical direction, considering a distribution pattern of data belonging to the second enhancement layer and first encodes a layer in which lots of data are distributed among the divided layers, loss of audio information can be minimized even if a portion of the encoded second enhancement layer is damaged.

24 Claims, 5 Drawing Sheets

SCALABLE AUDIO ENCODING AND DECODING APPARATUS, METHOD, AND MEDIUM

CROSS-REFERENCE TO RELATED APPLICATIONS

This application claims the benefit of Korean Patent Application No. 10-2005-0090747, filed on Sep. 28, 2005, in the Korean Intellectual Property Office, the disclosure of which is incorporated herein in its entirety by reference.

BACKGROUND OF THE INVENTION

1. Field of the Invention

The present invention relates to encoding and decoding, and more particularly, to a scalable encoding and decoding apparatus, method, and medium for decoding a partially damaged encoding frame to perceive (recognize) audio information contained in the encoding frame by encoding a single frame in the order of a base layer, a first enhancement layer, and a second enhancement layer and also performing scalable encoding of the second enhancement layer.

2. Description of the Related Art

G.729 is a standard adopted by the ITU Telecommunication Standardization Sector (ITU-T) of the International Telecommunication Union (ITU). G.729, selected as a standard of a speech data encoding and decoding method, does not support scalable encoding. For example, when speech data is encoded from a low frequency band to a high frequency band using the method, the encoded speech data may be partially damaged when passing a channel, and in this case, the encoded speech data in the high frequency band is damaged prior to the encoded speech data in the low frequency band.

In a conventional speech standardization technology, when encoded speech data is partially damaged, a frequency band having no speech data may occur. Thus, according to a conventional speech encoding and decoding apparatus and method, when encoded speech data is partially damaged, a frequency band having no speech data may exist among frequency bands having speech information in encoding, and in this case, decoded speech data can be inaudible.

SUMMARY OF THE INVENTION

Additional aspects, features, and/or advantages of the invention will be set forth in part in the description which follows and, in part, will be apparent from the description, or may be learned by practice of the invention.

The present invention provides a scalable encoding and decoding apparatus, method, and medium for decoding a partially damaged encoding frame to perceive (recognize) audio information contained in the encoding frame by encoding a single frame in the order of a base layer, a first enhancement layer, and a second enhancement layer and also performing scalable encoding of the second enhancement layer.

According to an aspect of the present invention, there is provided a scalable encoding apparatus including a scalable encoder to encode a base layer, a first enhancement layer, and a second enhancement layer in a frame having the base layer; and an encoding frame generator to generate an encoded frame by synthesizing the encoded results, wherein the base layer is a layer encoded using a predetermined encoding method, a low frequency band of the frame is a frequency band of the base layer, and a high frequency band of the frame is a frequency band of the first enhancement layer.

According to another aspect of the present invention, there is provided a scalable encoding method including encoding a base layer, a first enhancement layer, and a second enhancement layer in a frame having the base layer; and generating an encoded frame by synthesizing the encoded results, wherein the base layer is a layer encoded using a predetermined encoding method, a low frequency band of the frame is a frequency band of the base layer, and a high frequency band of the frame is a frequency band of the first enhancement layer.

According to another aspect of the present invention, there is provided a scalable decoding apparatus including an encoding frame divider to divide an encoded frame into a base layer, a first enhancement layer, and a second enhancement layer; and a scalable decoder to decode the base layer, the first enhancement layer, and the second enhancement layer, wherein the base layer is a layer decoded using a predetermined decoding method, a low frequency band of the frame is a frequency band of the base layer, and a high frequency band of the frame is a frequency band of the first enhancement layer.

According to another aspect of the present invention, there is provided a scalable decoding method including dividing an encoded frame into a base layer, a first enhancement layer, and a second enhancement layer; and decoding the base layer, the first enhancement layer, and the second enhancement layer, wherein the base layer is a layer decoded using a predetermined decoding method, a low frequency band of the frame is a frequency band of the base layer, and a high frequency band of the frame is a frequency band of the first enhancement layer.

According to another aspect of the present invention, there is provided at least one computer readable medium storing instructions that control at least one processor to perform a scalable encoding method including encoding a base layer, a first enhancement layer, and a second enhancement layer in a frame having the base layer; and generating an encoded frame by synthesizing the encoded results, wherein the base layer is a layer to be encoded using a predetermined encoding method, a low frequency band of the frame is a frequency band of the base layer, a high frequency band of the frame is a frequency band of the first enhancement layer, and the size of data belonging to the first enhancement layer is a result obtained by summing the size of data belonging to the base layer and the size of data belonging to the second enhancement layer.

According to another aspect of the present invention, there is provided at least one computer readable medium storing instructions that control at least one processor to perform a scalable decoding method including dividing an encoded frame into a base layer, a first enhancement layer, and a second enhancement layer; and decoding the base layer, the first enhancement layer, and the second enhancement layer, wherein the base layer is a layer to be decoded using a predetermined decoding method, a low frequency band of the frame is a frequency band of the base layer, and a high frequency band of the frame is a frequency band of the first enhancement layer.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION OF THE PREFERRED EMBODIMENTS

Figure 1:
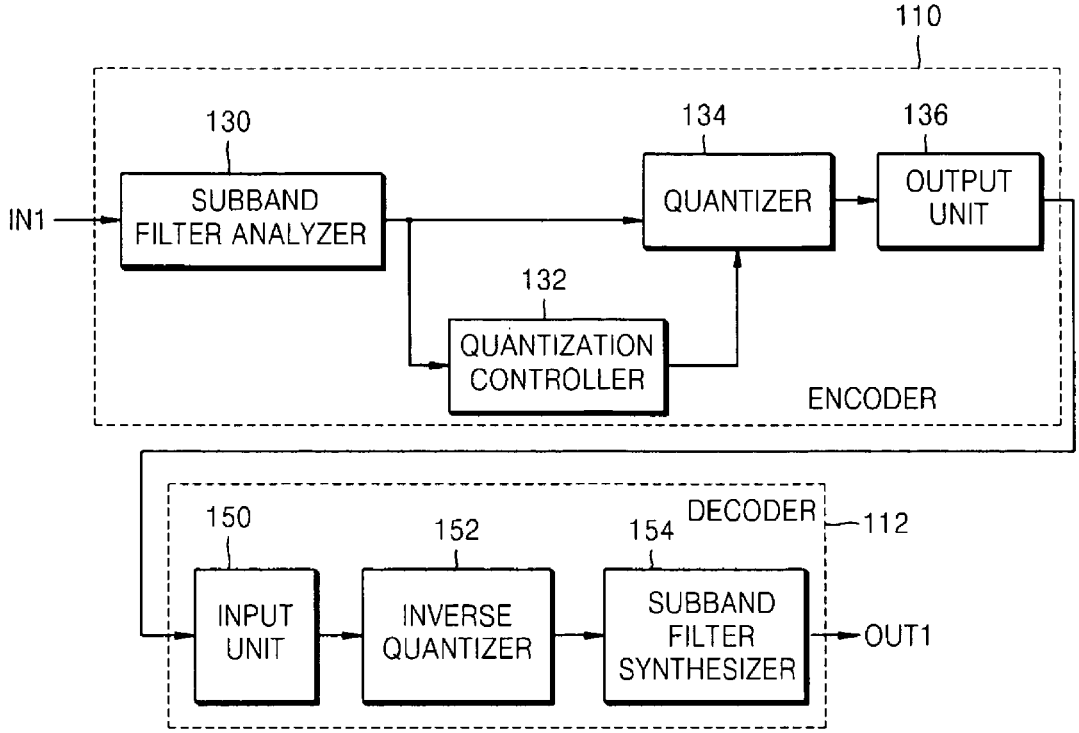
FIG. 1 is a block diagram of a scalable encoding and decoding apparatus according to an exemplary embodiment of the present invention.

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

FIG. 1 is a block diagram of a scalable encoding and decoding apparatus according to an exemplary embodiment of the present invention, which includes an encoder 110 and a decoder 112, wherein the encoder 110 includes a subband filter analyzer 130, a quantization controller 132, a quantizer 134, and an output unit 136, and wherein the decoder 112 includes an input unit 150, an inverse quantizer 152, and a subband filter synthesizer 154.

Referring to FIG. 1, the encoder 110 encodes a speech signal input through an input terminal IN1 and transmits the encoded speech signal to the decoder 112. The decoder 112 decodes the speech signal encoded by the encoder 110 and outputs the decoded speech signal through an output terminal OUT1.

An input signal input through the input terminal IN1 may be a speech signal as described above or an audio or video signal different from the former. For the convenience of description, it is assumed that the input signal input through the input terminal IN1 is a speech signal.

The speech signal is input through the input terminal INI for a predetermined time, and it is preferable that the predetermined time be defined in advance. In addition, it is preferable that the input speech signal be a signal constructed of a plurality of discrete data in a time domain, such as a Pulse Coding Modulation (PCM) signal.

It is preferable that the speech signal input for the predetermined time be composed of a plurality of frames. Here, a frame is a single processing unit of encoding and/or decoding.

The subband filter analyzer 130 generates speech data in a frequency domain by subband filtering the input speech signal. It is preferable that the generated speech data be composed of a plurality of subbands, wherein each subband has a predetermined frequency band and speech data in each frequency band is quantized into a predetermined number of bits.

If the signal input through the input terminal IN1 is a speech signal, a frequency band of each frame is a frequency band that speech can have. Although an individual difference exists, 0~7 KHz can be an example of a speech frequency band.

The subband filter analyzer 130 outputs the generated speech data, which is a result obtained by subband filtering the speech signal input through the input terminal IN1, to the quantization controller 132 and the quantizer 134.

The quantization controller 132 analyzes sensitivity of hearing, generates a step size control signal according to the analysis result, and outputs the generated step size control signal to the quantizer 134.

The quantizer 134 quantizes the subband filtered result and outputs the quantized result to the output unit 136. Here, the quantizer 134 adjusts a quantization step size in response to the step size control signal input from the quantization controller 132.

The output unit 136 generates at least one encoding frame by encoding the quantized result input from the quantizer 134. That is, the at least one encoding frame denotes the quantized result.

In addition, the output unit 136 bit packs the generated encoding frame, converts the bit packed result to a bit stream, stores the converted bit stream, and transmits the converted bit stream to the decoder 112. Here, the encoding can be lossless encoding. In this case, the output unit 136 can use the Huffman encoding for the lossless encoding.

According to the present invention, the encoder 110 may not include the quantization controller 132. In this case, the encoder 110 is implemented only with the subband filter analyzer 130, the quantizer 134, and the output unit 136.

The input unit 150 receives the bit stream transmitted from the output unit 136 of the encoder 110, bit unpacks the received bit stream, lossless decodes the bit unpacked result, and outputs the lossless decoded result to the inverse quantizer 152. The Huffman decoding is an example of the lossless decoding.

The inverse quantizer 152 inputs and inverse quantizes the lossless decoded result input from the input unit 150 and outputs the inverse quantized result to the subband filter synthesizer 154.

The subband filter synthesizer 154 subband filters the inverse quantized result and outputs the subband filtered result through the output terminal OUT1 as a restored speech signal.

Figure 2:
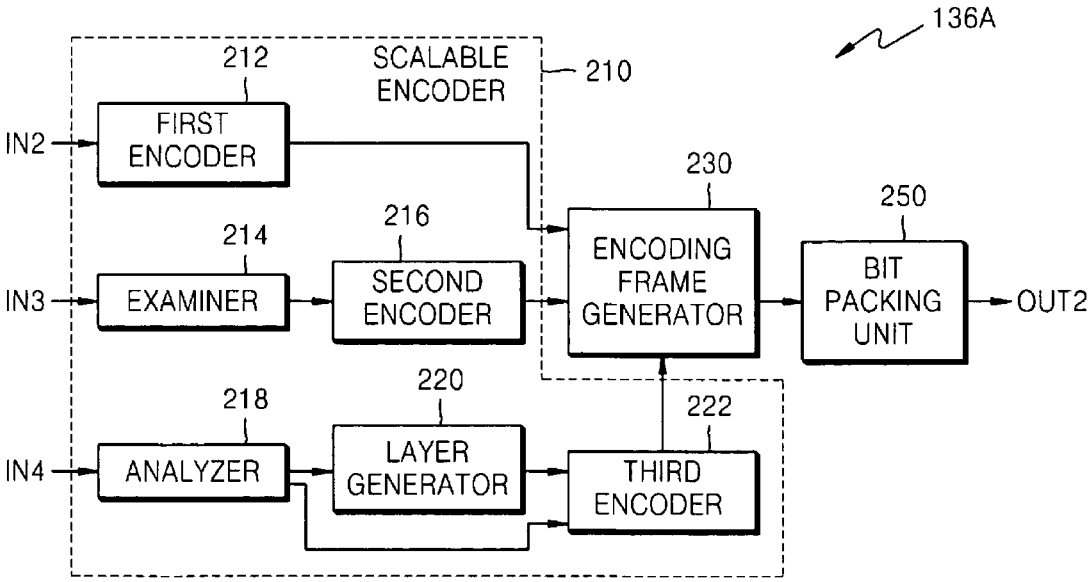
FIG. 2 is a detailed block diagram of an output unit illustrated in FIG. 1.

FIG. 2 is a detailed block diagram of an example 136A of the output unit 136 illustrated in FIG. 1 according to an exemplary embodiment of the present invention, which includes a scalable encoder 210, an encoding frame generator 230, a bit packing unit 250, wherein the scalable encoder 210 includes a first encoder 212, an examiner 214, a second encoder 216, an analyzer 218, a layer generator 220, and a third encoder 222.

Figure 3:
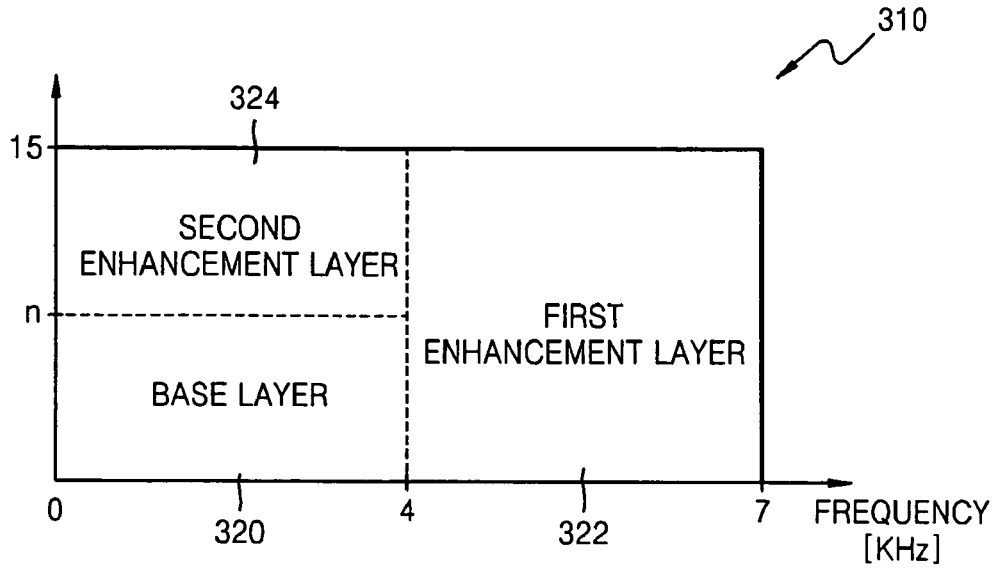
FIG. 3 is a reference diagram for explaining a process of performing scalable encoding of a frame according to an exemplary embodiment of the present invention.
Figure 4:
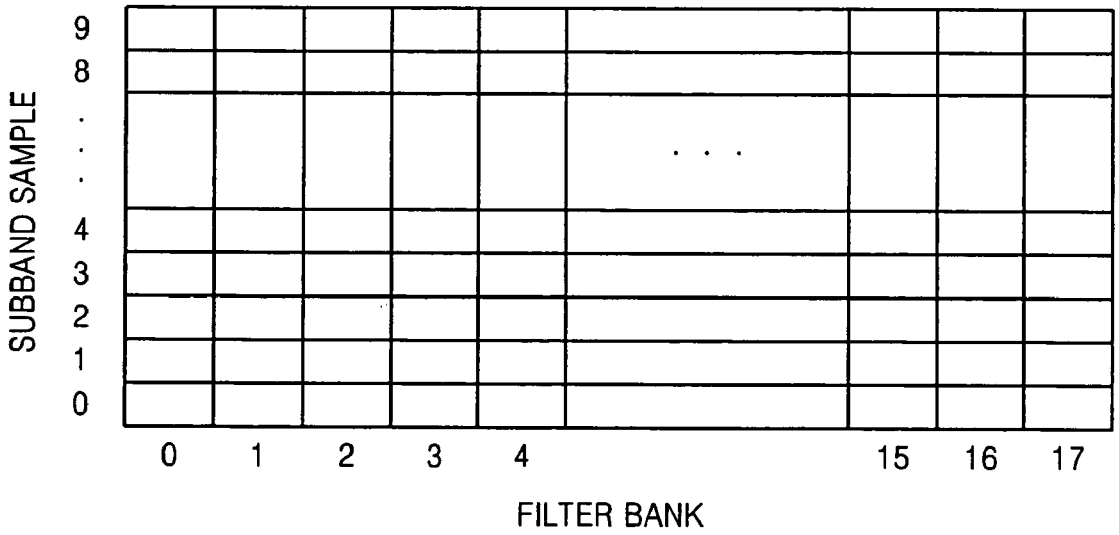
FIG. 4 is a reference diagram for explaining a process of performing scalable encoding of a second enhancement layer according to an exemplary embodiment of the present invention.

A configuration and operation of the output unit 136A illustrated in FIG. 2 will now be described with reference to FIGS. 3 and 4. FIG. 3 is a reference diagram for explaining a process of performing scalable encoding of a frame according to an exemplary embodiment of the present invention, and FIG. 4 is a reference diagram for explaining a process of performing scalable encoding of a second enhancement layer according to an exemplary embodiment of the present invention.

IN2, IN3, and IN4 denote results quantized by the quantizer 134 of the encoder 110. That is, IN2, IN3, and IN4 denote quantized frames. Each frame 310 is composed of a base layer 320, a first enhancement layer 322, and a second enhancement layer 324 as illustrated in FIG. 3. In FIG. 4, the vertical axis denotes time, and the horizontal axis denotes frequency. If data corresponding to a KHz is represented with M bits from $n+1^{th}$ data to $n+M^{th}$ data, a bit resolution of the data corresponding to a KHz can be represented as M.

In detail, IN2, IN3, and IN4 correspond to the base layer 320, the first enhancement layer 322, and the second enhancement layer 324, respectively. The base layer 320 is a layer encoded in a predetermined encoding method. To do this, it is preferable that the output unit 136 includes a speech codec. The speech codec may be a codec not supporting 'scalable encoding' described below. For example, a standard to which a form of the predetermined encoding method performed by the speech codec belongs can be G.729 or G.729E.

Hereinafter, for the convenience of description, it is assumed that the standard to which the form of the predetermined encoding method belongs is G.729E. Likewise, it is assumed that a frequency band encoded according to the standard is 0 to 4 KHz as illustrated in FIG. 3. In addition, it is assumed that data in every frequency band of the base layer 320 is composed of n+1 bits (n is 0 or a positive integer below 15).

A low frequency band of the frame 310 can denote a frequency band of the base layer 320, and a high frequency band of the frame 310 can denote a frequency band of the first enhancement layer 322. In FIG. 3, the low frequency band of the frame 310 is equal to 0 KHz or more than 0 KHz and less than 4 KHz, and the high frequency band is equal to 4 KHz or more than 4 KHz and less than 7 KHz.

The scalable encoder 210 encodes the base layer 320 and encodes the first enhancement layer 322 and the second enhancement layer 324 in a frame having the base layer 320. In more detail, the scalable encoder 210 sequentially encodes the base layer 320, the first enhancement layer 322, and the second enhancement layer 324.

To do this, the scalable encoder 210 includes the first encoder 212, the second encoder 216, and the third encoder 222, wherein the first encoder 212 encodes the base layer 320 (IN2), the second encoder 216 encodes the first enhancement layer 322 (IN3), and the third encoder 222 encodes the second enhancement layer 324 (IN4).

It is preferable that the first encoder 212 be implemented with a codec supporting the scalable encoding as G.729E, a standard encoding/decoding method, as described above.

The second encoder 216 can encode the first enhancement layer 322 in response to a result examined by the examiner 214. The examiner 214 examines similarity between a frequency distribution of the base layer 320 and a frequency distribution of the first enhancement layer 322. In more detail, the examiner 214 examines similarity between a frequency spectrum of the base layer 320 and a frequency spectrum of the first enhancement layer 322.

If the examiner 214 examines that the examined similarity is greater than a predetermined threshold, the second encoder 216 outputs an encoded result of the base layer 320 output from the first encoder 212 as an encoded result of the first enhancement layer 322. A correlation noise substitution (CNS) method disclosed in Korean Patent Application No. 10-2004-0099742 has been introduced as this encoding method.

If the examiner 214 examines that the examined similarity is less than the predetermined threshold, the second encoder 216 can encode the first enhancement layer 322 using a general encoding method. The general encoding method can be a random noise substitution (RNS) method. The RNS method is also disclosed in Korean Patent Application No. 10-2004-0099742.

While the CNS method and the RNS method are suggested for the convenience of description, the present invention is not limited to these methods. The examiner 214 can be placed out of the scalable encoder 210. For example, the examiner 214 can be placed between the subband filter analyzer 130 and the quantizer 134 in parallel with the quantization controller 132.

Operations of the analyzer 218, the layer generator 220, and the third encoder 222 will now be described with reference to FIG. 4. FIG. 4 illustrates the second enhancement layer 324 with time as the vertical axis and frequency as the horizontal axis. A frequency corresponding to single data belonging to the second enhancement layer 324 of FIG. 3 can belong to one of 18 filter banks, $0^{th}$ to $17^{th}$ filter banks, in FIG. 4. Here, while 18 is a number suggested for the convenience of description, the present invention is not limited to this.

A filter bank denotes a portion of a frequency band of the second enhancement layer 324. Thus, the horizontal axis of FIG. 4 may denote the filter bank. If the length in a frequency domain corresponding to each filter bank is the same, a frequency band corresponding to a $0^{th}$ filter bank in FIG. 4 is 0 KHz to 4000/18 KHz, and a frequency band corresponding to a second filter bank is (4000/18)×2 KHz to (4000/18)×3 KHz.

Since the order of time exists in the same frame 310, the order of time also exists in the second enhancement layer 324. The vertical axis of FIG. 4 denotes the order of time. A time band corresponding to single data belonging to the second enhancement layer 324 of FIG. 3 can belong to one of 10 subband samples, $0^{th}$ to $9^{th}$ subband samples, in FIG. 4. Here, while 10 is a number suggested for the convenience of description, the present invention is not limited to this.

The total time band of data belonging to the second enhancement layer 324 may be represented with a plurality of subband samples. In this case, a subband sample denotes a portion of the total time band T of the second enhancement layer 324.

That is, the vertical axis of FIG. 4 can represent 'subband sample'. If the length in a time domain corresponding to each subband sample is the same, a time band corresponding to a $0^{th}$ subband sample in FIG. 4 is 0 to T/10 seconds, and a time band corresponding to a second subband sample in FIG. 4 is (T/10)×2 to (T/10)×3.

The analyzer 218 analyzes the second enhancement layer 324 and outputs the analysis result as a layer generation signal. In more detail, the analyzer 218 analyzes a distribution pattern in the frame 310 of the data belonging to the second enhancement layer 324, generates a layer generation signal corresponding to the analysis result, and outputs the generated layer generation signal to the layer generator 220.

For example, each of the data belonging to the second enhancement layer 324 is composed of at least one bit, and the analyzer 218 can analyze a pattern that bits of the data belonging to the second enhancement layer 324 distributed in the second enhancement layer 324. That is, the analyzer 218 can analyze a bit allocation distribution pattern inside the second enhancement layer 324.

The analyzer 218 also can search for a representative value for each filter bank and analyze a pattern that the found representative values are distributed in the second enhancement layer 324. Hereinafter, the representative value is called a scalefactor. In FIG. 4, a $p^{th}$ filter bank (p is an integer equal to or more than 0 and equal to or less than 17) corresponds to 10 subband samples, and a maximum value of data values of the 10 subband samples can be called a scalefactor of the $p^{th}$ filter bank. That is, the analyzer 218 can analyze a distribution pattern of scalefactors inside the second enhancement layer 324.

As described above, the analyzer 218 generates a layer generation signal corresponding to the analyzed pattern and outputs the generated layer generation signal to the layer generator 220.

The layer generator 220 divides the second enhancement layer 324 into a plurality of layers in response to the layer generation signal. In FIG. 4, the second enhancement layer 324 can be constructed with 180 lattices.

It is preferable that the third encoder 222 encodes the plurality of divided layers in response to the layer generation signal. That is, it is preferable that the layer generation signal contains information regarding how to divide the second enhancement layer 324 and generate the layers and information regarding how to encode the plurality of divided layers.

The operations of the analyzer 218, the layer generator 220, and the third encoder 222 will now be described in more detail using the illustrations described below.

For example, if it is analyzed that 90 % of the data belonging to the second enhancement layer 324 is distributed between the $0^{th}$ subband sample and the $4^{th}$ subband sample, it is preferable that the layer generator 220 generates a plurality of layers by dividing the second enhancement layer 324 in the vertical direction. In FIG. 4, 10 layers can be generated by this layer generation operation.

In this case, the third encoder 222 can sequentially encode all data from data corresponding to the $0^{th}$ subband sample to data corresponding to the $9^{th}$ subband sample.

Likewise, if it is analyzed that 90 % of the data belonging to the second enhancement layer 324 is distributed between the $0^{th}$ filter bank and the second filter bank, it is preferable that the layer generator 220 generates a plurality of layers by dividing the second enhancement layer 324 in the horizontal direction. In FIG. 4, 18 layers can be generated by this layer generation operation.

In this case, the third encoder 222 can sequentially encode all data from data corresponding to the $0^{th}$ filter bank to data corresponding to the $17^{th}$ filter bank.

If it is analyzed that 90 % of the data belonging to the second enhancement layer 324 is distributed in the $0^{th}$ subband sample and even-number-th subband samples, it is preferable that the layer generator 220 generates a plurality of layers by dividing the second enhancement layer 324 in the vertical direction. Here, the third encoder 222 can encode the data in the order of data corresponding to the $0^{th}$ subband sample, data corresponding to the second subband sample, data corresponding to the $4^{th}$ subband sample, . . . , data corresponding to the $8^{th}$ subband sample, data corresponding to the first subband sample, data corresponding to the third subband sample, . . . , and data corresponding to the $9^{th}$ subband sample.

That is, the third encoder 222 can encode a plurality of layers not only sequentially but also in a predetermined sequence. For example, the third encoder 222 can encode an $(a+2)^{th}$ layer without encoding an $(a+1)^{th}$ layer right after encoding an $a^{th}$ layer as described above. In this case, an interleaving unit value is 2.

Likewise, if the third encoder 222 encodes an $(a+3)^{th}$ layer right after encoding the $a^{th}$ layer, the interleaving unit value is 3. This interleaving unit value can be determined according to a result analyzed by the analyzer 218.

Thus, it is preferable that the layer generation signal contains information regarding a pattern that data is distributed in the second enhancement layer 324, the layer generator 220 generates layers in response to the layer generation signal so that more data are distributed in a previously generated layer than a later generated layer, and the third encoder 222 encodes the layers in response to the layer generation signal.

Accordingly, the layer generator 220 and the third encoder 222 operate by reflecting a pattern that important lattices among the lattices belonging to the second enhancement layer 324 are distributed. Here, an important lattice is a lattice having nonzero data.

The encoding frame generator 230 generates an 'encoding frame', which is the frame 310 encoded by synthesizing a result encoded by the first encoder 212, a result encoded by the second encoder 216, and a result encoded by the third encoder 222.

The bit packing unit 250 bit packs the generated at least one encoding frame and converts the bit packed result to a bit stream. Reference character OUT2 denotes the converted bit stream.

Even if the encoding frame encoded by the scalable encoding according to an exemplary embodiment of the present invention is partially damaged in a process of transmitting it to the decoder 112, speech information contained in a frame decoded by the decoder 112 can be perceived (recognized) by a human body as described below.

Loss of an encoding frame occurs in an opposite order of the encoded order. For example, if an encoding frame is generated by encoding one layered frame from a low frequency band to a high frequency band, loss of the encoding frame occurs from the encoding frame in the high frequency band to the encoding frame in the low frequency band.

Considering that important information exists in general in the low frequency band than the high frequency band, a conventional encoding apparatus generates an encoding frame by encoding one layered frame from the low frequency band to the high frequency band to prevent loss of the encoding frame in the low frequency band, which is an encoding frame in which important information is relatively much distributed, by letting loss occur from the encoding frame in the high frequency band when loss of the encoding frame occurs.

However, since much speech information in the high frequency band can be damaged according to the conventional encoding apparatus, a frequency band from which any speech information cannot be restored can exist among all frequency bands of an encoding frame, and accordingly, a case where speech restoration must be given up with respect to partial frequency bands may occur.

On the contrary, by the scalable encoding according to an exemplary embodiment of the present invention, since a frame is encoded in the order of the base layer 320, the first enhancement layer 322, and the second enhancement layer 324, loss of the encoding frame can occur in the order of the encoded second enhancement layer 324, the encoded first enhancement layer 322, and the encoded base layer 320.

Thus, when the loss of the encoding frame ends with loss of the encoded second enhancement layer 324, the encoded base layer 320 and the encoded first enhancement layer 322 can be losslessly decoded, and accordingly, speech information can be restored with respect to all frequency bands of the encoding frame.

Figure 5:
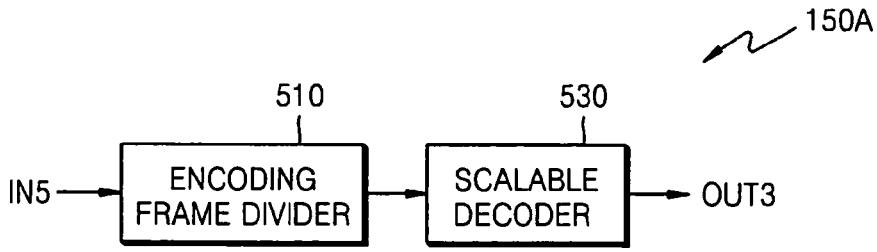
FIG. 5 is a detailed block diagram of an input unit illustrated in FIG. 1.

FIG. 5 is a detailed block diagram of an example 150A of the input unit 150 illustrated in FIG. 1 according to an exemplary embodiment of the present invention, which includes an encoding frame divider 510 and a scalable decoder 530. Here, IN5 denotes a bit stream transmitted from the encoder 110, and OUT3 denotes a decoded result outputting to the inverse quantizer 152.

The encoding frame divider 510 divides an encoding frame, which is an encoded frame, into a base layer, a first enhancement layer, and a second enhancement layer, and the scalable decoder 530 decodes the base layer, the first enhancement layer, and the second enhancement layer and outputs the decoded results to the inverse quantizer 152.

Figure 6:
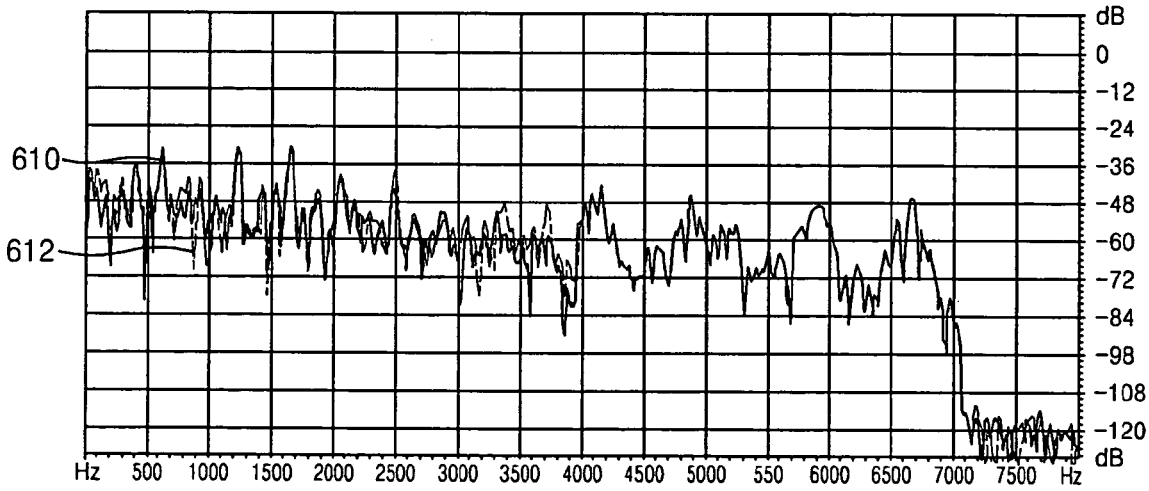
FIG. 6 is a waveform diagram illustrating a speech quality difference with respect to frequencies of a lower layer and an upper layer.

FIG. 6 is a waveform diagram illustrating a speech quality difference with respect to frequencies of a lower layer and an upper layer. Here, a lower layer of the frame 310 denotes the base layer 320 and the first enhancement layer 322, and an upper layer of the frame 310 denotes all of the base layer 320, the first enhancement layer 322, and the second enhancement layer 324.

For example, it is assumed that the encoder 110 transmits data to the decoder 112 at a 32 Kbps bit rate through a single encoding frame 310. In detail, it is assumed that the encoder 110 transmits data at an 11 Kbps bit rate through the base layer 320 encoded in a G.729E standard format, transmits data at a 3 Kbps bit rate through the first enhancement layer 322 encoded using the CNS method, and transmits data at an 18 Kbps bit rate through the second enhancement layer 324 encoded using the Huffman encoding method.

In this case, the encoder 110 transmits data to the decoder 112 at a 14 Kbps bit rate through the lower layer of the frame 310 and transmits data to the decoder 112 at a 32 Kbps bit rate through the upper layer of the frame 310.

The vertical axis of FIG. 6 denotes frequency [Hz], and the horizontal axis denotes the intensity [dB]of a restored speech signal. Here, the intensity of a speech signal denotes quality of the speech signal. As illustrated in FIG. 6, according to an exemplary embodiment of the present invention, the intensity of a second restoration signal 612, which is a speech signal corresponding to data belonging to a restored upper layer, is similar all over the entire frequency band to the intensity of a first restoration signal 610, which is a speech signal corresponding to data belonging to a restored lower layer.

That is, even if a portion of the data belonging to the encoded second enhancement layer 324 is damaged because of a partial loss of an encoding frame, only if the first enhancement layer 322 is not damaged, a speech signal can be restored all over the entire frequency band of the encoding frame.

Figure 7:
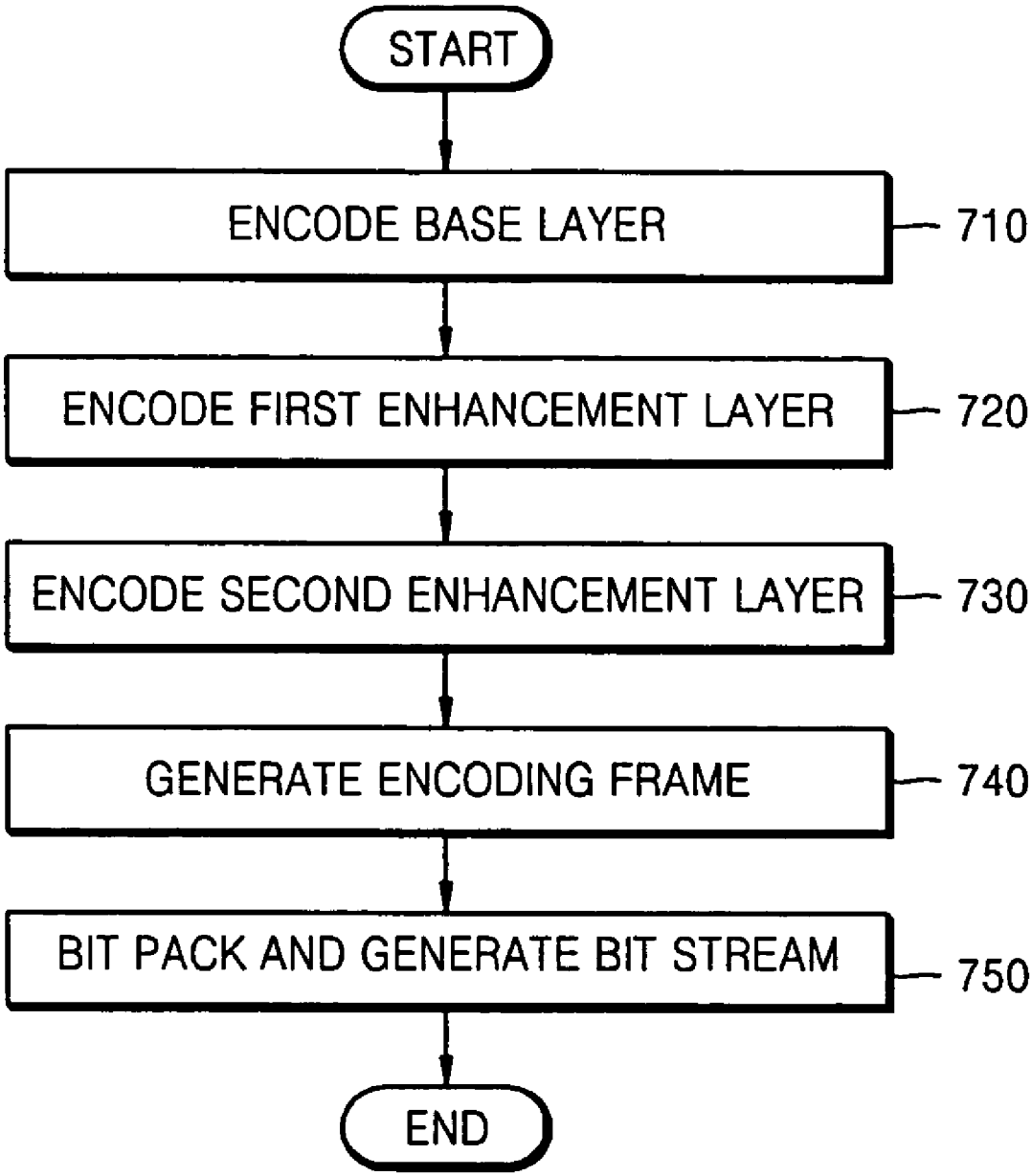
FIG. 7 is a flowchart of a scalable encoding method according to an exemplary embodiment of the present invention.

FIG. 7 is a flowchart of a scalable encoding method according to an exemplary embodiment of the present invention, which includes encoding a frame (operations 710 through 740) and generating a bit stream (operation 750).

Referring to FIG. 7, the scalable encoder 210 encodes the base layer 320 in operation 710, encodes the first enhancement layer 322 in operation 720, and encodes the second enhancement layer 324 in operation 730.

The encoding frame generator 230 generates an encoding frame, which is a frame 310 encoded by synthesizing the encoded base layer 320, the encoded first enhancement layer 322, and the encoded second enhancement layer 324 in operation 740.

The bit packing unit 250 bit packs the generated encoding frame and converts the bit packed result to a bit stream in operation 750.

Figure 8:
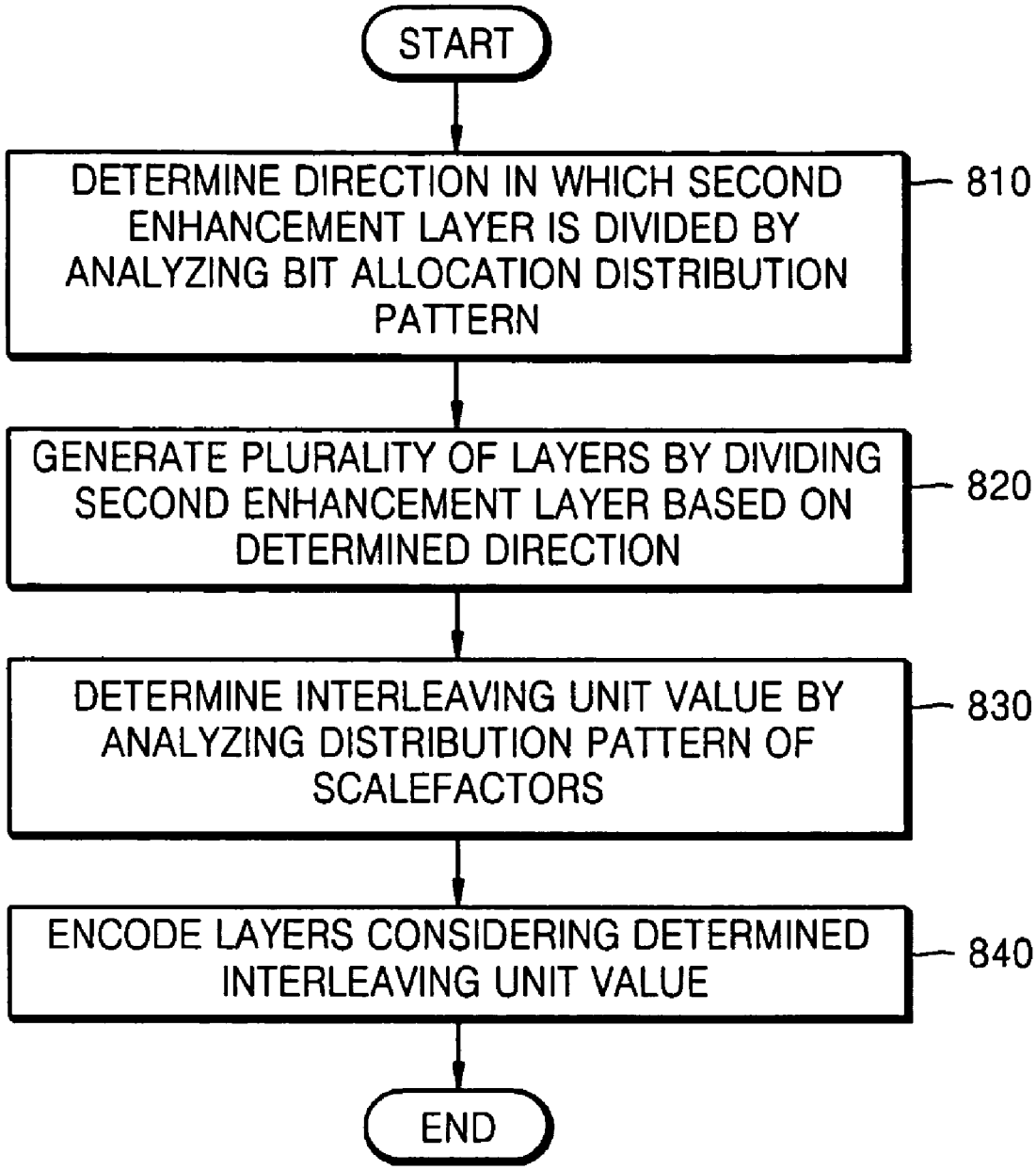
FIG. 8 is a detailed flowchart of operation 730 illustrated in FIG. 7.

FIG. 8 is a detailed flowchart of an example of operation 730 illustrated in FIG. 7 according to an exemplary embodiment of the present invention, which includes analyzing the second enhancement layer 324, generating a plurality of layers by reflecting the analysis result and dividing the second enhancement layer 324, and encoding the plurality of generated layers (operations 810 through 840).

Referring to FIG. 8, the analyzer 218 determines a direction in which the second enhancement layer 324 is divided by analyzing a distribution pattern of data belonging to the second enhancement layer 324 in operation 810. For example, the analyzer 218 can determine a direction in which the second enhancement layer 324 is divided by analyzing a bit allocation distribution pattern of the data belonging to the second enhancement layer 324.

The layer generator 220 generates a plurality of layers by dividing the second enhancement layer 324 based on the determined direction in operation 820. In operation 830, the analyzer 218 can determine an interleaving unit value N using the result analyzed in operation.

According to an exemplary embodiment of the present invention, operation 830 illustrated in FIG. 8 can be performed prior to operation 820.

The third encoder 222 encodes the plurality of divided layers considering the determined interleaving unit value N in operation 840.

In addition to the above-described exemplary embodiments, exemplary embodiments of the present invention can also be implemented by executing computer readable code/instructions in/on a medium/media, e.g., a computer readable medium/media. The medium/media can correspond to any medium/media permitting the storing and/or transmission of the computer readable code/instructions. The medium/media may also include, alone or in combination with the computer readable code/instructions, data files, data structures, and the like. Examples of code/instructions include both machine code, such as produced by a compiler, and files containing higher level code that may be executed by a computing device and the like using an interpreter.

The computer readable code/instructions can be recorded in/on a medium/media in a variety of ways, with examples of the medium/media including magnetic storage media (e.g., floppy disks, hard disks, magnetic tapes, etc.), optical media (e.g., CD-ROMs, or DVDs), magneto-optical media (e.g., floptical disks), and hardware storage devices (e.g., read only memory media, random access memory media, flash memories, etc.). The medium/media may also be a distributed network, so that the computer readable code/instructions are stored and executed in a distributed fashion. The computer readable code/instructions may be executed by one or more processors. The computer readable code/instructions may also be executed and/or embodied in at least one application specific integrated circuit (ASIC) or field programmable gate array (FPGA).

In addition, hardware devices may be configured to act as one or more software modules in order to perform the operations of the above-described exemplary embodiments. Examples of these hardware devices include at least one application specific integrated circuit (ASIC) or field programmable gate array (FPGA). A module may advantageously be configured to reside on the addressable storage medium and configured to execute on one or more processors. A module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and modules may be combined into fewer components and modules or further separated into additional components and modules. In addition, the components and the modules can operate at least one processor (e.g. central processing unit (CPU)) provided in a device. A module can be implemented by a Field Programmable Gate Array (FPGA) or an Application Specific Integrated Circuit (ASIC). Also, one or more types of other processors and/or hardware devices may also be used to implement/execute the operations of the software modules. In addition, an ASIC or FPGA may be considered to be a processor.

The computer readable code/instructions and computer readable medium/media may be those specially designed and constructed for the purposes of the present invention, or they may be of the kind well-known and available to those skilled in the art of computer hardware and/or computer software.

As described above, by using a scalable encoding and decoding apparatus, method, and medium according to exemplary embodiments of the present invention, since a frame is encoded in the order of a base layer, a first enhancement layer, and a second enhancement layer and scalable encoding of the second enhancement layer is also performed, even if a portion of the encoded second enhancement layer is damaged because of a loss of an encoding frame, a frequency band containing no audio information does not exist among all frequency bands of the encoding frame, and accordingly, audio information of the partially damaged encoding frame can be perceived (recognized).

Thus, only if the loss of the encoding frame is not as great as the encoded first enhancement layer is damaged, a case where speech restoration with respect to partial frequency bands must be given up does not occur.

Furthermore, since an encoder divides the second enhancement layer into a plurality of layers considering a distribution pattern of data belonging to the second enhancement layer and first encodes a layer in which lots of data are distributed among the divided layers, loss of audio information can be minimized even if a portion of the encoded second enhancement layer is damaged.

Although a few exemplary embodiments of the present invention have been shown and described, it would be appreciated by those skilled in the art that changes may be made in these exemplary embodiments without departing from the principles and spirit of the invention, the scope of which is defined in the claims and their equivalents.

What is claimed is:

1. A scalable encoding apparatus comprising:

a scalable encoder to encode a base layer, a first enhancement layer, and a second enhancement layer in a frame having the base layer; and an encoding frame generator to generate an encoded frame by synthesizing the encoded results, wherein the base layer comprises higher bits among bits by which data belonging to a low frequency band of the frame is represented, the second enhancement layer comprises lower bits other than the higher bits among bits by which data belonging to the low frequency band of the frame is represented, the first enhancement layer comprises lower bits other than the higher bits among bits by which data belonging to a high frequency band of the frame is represented, a division direction of the second enhancement layer is determined on a basis of a distribution pattern of data belonging to the second enhancement layer, and the second enhancement layer is divided into a plurality of layers according to the determined division direction, and wherein the determined division direction is a horizontal direction or a vertical direction.

2. The apparatus of claim 1, wherein the scalable encoder encodes the first enhancement layer after encoding the base layer, and encodes the second enhancement layer after encoding the first enhancement layer.

3. The apparatus of claim 1, wherein the scalable encoder comprises an examiner to examine similarity between a frequency distribution of the base layer and a frequency distribution of the first enhancement layer and outputs the encoded result of the base layer as the encoded result of the first enhancement layer in response to the examined result.

4. The apparatus of claim 1, wherein the scalable encoder comprises:

an analyzer to analyze the second enhancement layer and outputting the analyzed result as a layer generation signal; and a layer generator to divide the second enhancement layer into a plurality of layers in response to the layer generation signal, wherein encoding of the plurality of divided layers is encoding of the second enhancement layer.

5. The apparatus of claim 4, wherein the scalable encoder encodes the plurality of divided layers in response to the layer generation signal.

6. The apparatus of claim 4, wherein the analyzer analyzes a distribution pattern in the frame of data belonging to the second enhancement layer and outputs the layer generation signal corresponding to the analyzed result.

7. The apparatus of claim 1, wherein the distribution pattern of data corresponds to at least one of a distribution pattern of bit allocation and a distribution pattern of scalefactors.

8. A scalable encoding method comprising:

encoding, using at least one processing device, a base layer, a first enhancement layer, and a second enhancement layer in a frame having the base layer; and generating an encoded frame by synthesizing the encoded results, wherein the base layer comprises higher bits among bits by which data belonging to a low frequency band of the frame is represented, the second enhancement layer comprises lower bits other than the higher bits among bits by which data belonging to the low frequency band of the frame is represented, the first enhancement layer comprises lower bits other than the higher bits among bits by which data belonging to a high frequency band of the frame is represented, a division direction of the second enhancement layer is determined on a basis of a distribution pattern of data belonging to the second enhancement layer, and the second enhancement layer is divided into a plurality of layers according to the determined division direction, and wherein the determined division direction is a horizontal direction or a vertical direction.

9. The method of claim 8, wherein the encoding comprises:

encoding the base layer;

encoding the first enhancement layer after encoding the base layer; and encoding the second enhancement layer after encoding the first enhancement layer.

10. The method of claim 9, wherein the encoding of the first enhancement layer comprises:

determining whether similarity between a frequency distribution of the base layer and a frequency distribution of the first enhancement layer is greater than a predetermined threshold; and if it is determined that the similarity is greater than the threshold, generating the encoded result of the base layer as the encoded result of the first enhancement layer.

11. The method of claim 9, wherein the encoding of the second enhancement layer comprises:

analyzing the second enhancement layer;

dividing the second enhancement layer into a plurality of layers according to the analyzed result; and encoding the plurality of divided layers.

12. The method of claim 11, wherein in the analyzing, a distribution pattern in the frame of the data belonging to the second enhancement layer is analyzed.

13. The method of claim 11, wherein in the encoding of the plurality of divided layers, the plurality of divided layers are encoded according to the analyzed result.

14. The method of claim 8, wherein the distribution pattern of data corresponds to at least one of a distribution pattern of bit allocation and a distribution pattern of scalefactors.

15. A scalable decoding apparatus comprising:

an encoding frame divider to divide an encoded frame into a base layer, a first enhancement layer, and a second enhancement layer; and a scalable decoder to decode the base layer, the first enhancement layer, and the second enhancement layer, wherein the base layer comprises higher bits among bits by which data belonging to a low frequency band of the frame is represented, the second enhancement layer comprises lower bits other than the higher bits among bits by which data belonging to the low frequency band of the frame is represented, the first enhancement layer comprises lower bits other than the higher bits among bits by which data belonging to a high frequency band of the frame is represented, a division direction of the second enhancement layer is determined on a basis of a distribution pattern of data belonging to the second enhancement layer, and the second enhancement layer is divided into a plurality of layers according to the determined division direction, and wherein the determined division direction is a horizontal direction or a vertical direction.

16. The apparatus of claim 15, wherein the encoded frame is generated by sequentially synthesizing an encoded base layer, an encoded first enhancement layer, and an encoded second enhancement layer.

17. The apparatus of claim 15, wherein the second enhancement layer of the encoded frame comprises a plurality of divided layers, and the division is performed in response to a result obtained by analyzing a distribution pattern in the frame of data belonging to the second enhancement layer.

18. The apparatus of claim 15, wherein the distribution pattern of data corresponds to at least one of a distribution pattern of bit allocation and a distribution pattern of scalefactors.

19. A scalable decoding method comprising:

dividing an encoded frame into a base layer, a first enhancement layer, and a second enhancement layer; and decoding, using at least one processing device, the base layer, the first enhancement layer, and the second enhancement layer, wherein the base layer comprises higher bits among bits by which data belonging to a low frequency band of the frame is represented, the second enhancement layer comprises lower bits other than the higher bits among bits by which data belonging to the low frequency band of the frame is represented, the first enhancement layer comprises lower bits other than the higher bits among bits by which data belonging to a high frequency band of the frame is represented, a division direction of the second enhancement layer is determined on a basis of a distribution pattern of data belonging to the second enhancement layer, and the second enhancement layer is divided into a plurality of layers according to the determined division direction, and wherein the determined division direction is a horizontal direction or a vertical direction.

20. The method of claim 19, wherein the encoded frame is generated by sequentially synthesizing an encoded base layer, an encoded first enhancement layer, and an encoded second enhancement layer.

21. The method of claim 19, wherein the second enhancement layer of the encoded frame comprises a plurality of divided layers, and the division is performed in response to a result obtained by analyzing a distribution pattern in the frame of data belonging to the second enhancement layer.

22. The method of claim 19, wherein the distribution pattern of data corresponds to at least one of a distribution pattern of bit allocation and a distribution pattern of scalefactors.

23. At least one computer readable medium storing instructions that control at least one processor to perform a scalable encoding method comprising:

encoding a base layer, a first enhancement layer, and a second enhancement layer in a frame having the base layer; and generating an encoded frame by synthesizing the encoded results, wherein the base layer comprises higher bits among bits by which data belonging to a low frequency band of the frame is represented, the second enhancement layer comprises lower bits other than the higher bits among bits by which data belonging to the low frequency band of the frame is represented, the first enhancement layer comprises lower bits other than the higher bits among bits by which data belonging to a high frequency band of the frame is represented, a division direction of the second enhancement layer is determined on a basis of a distribution pattern of data belonging to the second enhancement layer, and the second enhancement layer is divided into a plurality of layers according to the determined division direction, and wherein the determined division direction is a horizontal direction or a vertical direction.

24. At least one computer readable medium storing instructions that control at least one processor to perform a scalable decoding method comprising:

dividing an encoded frame into a base layer, a first enhancement layer, and a second enhancement layer; and decoding the base layer, the first enhancement layer, and the second enhancement layer, wherein the base layer comprises higher bits among bits by which data belonging to a low frequency band of the frame is represented, the second enhancement layer comprises lower bits other than the higher bits among bits by which data belonging to the low frequency band of the frame is represented, the first enhancement layer comprises lower bits other than the higher bits among bits by which data belonging to a high frequency band of the frame is represented, a division direction of the second enhancement layer is determined on a basis of a distribution pattern of data belonging to the second enhancement layer, and the second enhancement layer is divided into a plurality of layers according to the determined division direction, and wherein the determined division direction is a horizontal direction or a vertical direction.

* * * * *